US007090038B2

(12) United States Patent
Lee

(10) Patent No.: US 7,090,038 B2
(45) Date of Patent: Aug. 15, 2006

(54) BEDROCK DRILLING AND EXCAVATING APPARATUS

(75) Inventor: Chin-Yi Lee, Taoyuan Hsien (TW)

(73) Assignee: Chuan Home Machinery Co., Ltd., Taoyuan Hsien (TW)

( * ) Notice: Subject to any disclaimer, the term of this patent is extended or adjusted under 35 U.S.C. 154(b) by 169 days.

(21) Appl. No.: 10/832,997

(22) Filed: Apr. 28, 2004

(65) Prior Publication Data

US 2005/0241859 A1 Nov. 3, 2005

(51) Int. Cl.
*E21B 10/36* (2006.01)

(52) U.S. Cl. ..... 175/296; 175/267; 175/305; 175/395

(58) Field of Classification Search ..... None
See application file for complete search history.

(56) References Cited

U.S. PATENT DOCUMENTS 6,454,025 B1 * 9/2002 Runquist et al. ..... 175/61

FOREIGN PATENT DOCUMENTS

TW 415320 12/1989
TW 356896 4/1999

* cited by examiner

*Primary Examiner*—Zakiya W. Bates
(74) *Attorney, Agent, or Firm*—Birch, Stewart, Kolasch & Birch, LLP

(57) ABSTRACT

A bedrock drilling and excavating apparatus receives power from a rotational power source to drive a drill to strike and shatter bedrock under the gravity of the apparatus and reciprocal vibrations of a pneumatic unit located on the apparatus. The apparatus includes a coupling device to couple with the rotational power source and an air intake vibration structure, a coupling sleeve which has one end coupling with the lower end of a coupling axle and a connector which further couples to the pneumatic unit, and a drill coupling to the pneumatic unit. The pneumatic unit drives the drill to vibrate up and down reciprocally to strike and shatter bedrock. The drill has a drill shell which is alterable according to the diameter of the service shaft without changing the diameter of the pneumatic unit. The drill shell has a plurality of conical drill gimlets mounted thereon in different biased angles to shatter the bedrock and improve drilling and excavating effect.

8 Claims, 11 Drawing Sheets

BEDROCK DRILLING AND EXCAVATING APPARATUS

FIELD OF THE INVENTION

The present invention relates to a bedrock drilling and excavating apparatus and particularly to a drilling and excavating apparatus that receives power from a rotational power source and has a pneumatic unit vibrating up and down reciprocally to drive drill gimlets to strike continuously downwards under the gravity of the drilling and excavating apparatus to shatter the bedrock.

BACKGROUND OF THE INVENTION

Drilling and excavating apparatus are generally being used on construction sites to drill and excavate the stratum. The stratum generally can be divided into soft stratum and hard stratum depending on the areas. In the countries of Southeast Asia (Such as Malaysia) the stratum usually is a hard type bedrock. The hardness increases as the depth of the bedrock increases.

The drills used in the conventional drilling and excavating operation such as the one disclosed in R.O.C. patent publication No. 356896 entitled "Improved structure for drilling sleeve" has a drill with a helical periphery. It may be rotated continuously to sink into the stratum. When drilling deeper into the stratum, the stratum becomes harder and drilling speed is slower. Sometimes drilling and excavation operations cannot be continued and have to stop. To remedy this problem, R.O.C. patent publication No. 415320 entitled: "Improvement for the drill of air hammer" proposes to use a pneumatic approach to drive the drill to generate up and down vibrations, and the drill has a high hardness steel ball to enhance the strength of drilling and excavation. During drilling and excavating operations, the drill is driven by the pneumatic air hammer to generate up and down vibration to shatter the bedrock. The drill structure of having the high hardness steel ball on one end is expensive. When the drilling diameter increases, the diameters of the drill and the air hammer also have to increase. The costs are higher. Moreover, to strike the hard bedrock through the high hardness steel ball is easy to damage the drill.

In addition, during operations, the steel ball on the plane of the drill strikes the bedrock vertically. It is less likely to create large cracks on the bedrock, and the drill is easily damaged. With the steel ball on the drill plane hitting the bedrock vertically, the longitudinal striking force causes dusts to drift vertically. The rotating drill that sinks deeply into the stratum often generates a great amount of dusts which spread like water fall. This results in an undesirable working environment and is harmful to the workers.

Furthermore, in terms of operations, the conventional drilling and excavating process of the bedrock mainly includes two stages: the first stage is to hoist the drilling and excavating apparatus by a heavy machinery and to drill the bedrock until reaching a selected depth, then withdraw the drill; the second stage is to sink an earth excavation barrel by the heavy machinery to excavate the shattered rocks and soils, then proceed the next drilling and excavating operation for a deeper stratum. The shattering operation of the first stage and the excavating operation of the second stage are repeatedly performed. To use merely a single heavy machinery to perform the operations, the hoisting head has to be replaced repeatedly. It will result in higher costs, increased operation time and greater risks. The heavy machinery used on the construction site usually is bulky and heavy. Operation is tedious and risk on the construction site is higher.

SUMMARY OF THE INVENTION

Therefore the primary object of the invention is to provide a drilling and excavating apparatus that receives power from a rotational power source. A pneumatic unit is provided which may vibrate up and down reciprocally to drive a drill to strike continuously downward under the gravity of the drilling and excavating apparatus to shatter the bedrock. A drill shell is provided that may be altered according to the diameter of the service shaft without changing the diameter of the pneumatic unit. The drill shell has a plurality of conical drill gimlets located thereon and arranged in different biased angles to strike and shatter bedrock effectively, and the drilling and excavation speed may increase.

The apparatus according to the invention includes a coupling device to transmit power of a rotational power source and channel air intake of an air pressure source to generate vibration. The coupling device has a coupling axle coupled by an air intake hood from outside. The coupling axle has an upper end to receive transmission input of the rotating power source. The air intake hood communicates with the coupling axle to receive compressed air from the air pressure source. A coupling sleeve is provided that has one end coupled with a lower end of the coupling axle and a connector which couples with a pneumatic unit. The pneumatic unit is coupled with a drill and drives the drill to vibrate reciprocally.

Another object of the invention is to provide an excavator to remove shattered rocks and waste soils from the service shaft while the drilling operation is proceeding in a single process, thereby to increase drilling and excavating efficiency.

Yet another object of the invention is to reduce the cost and prevent dusts from drifting and spreading.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
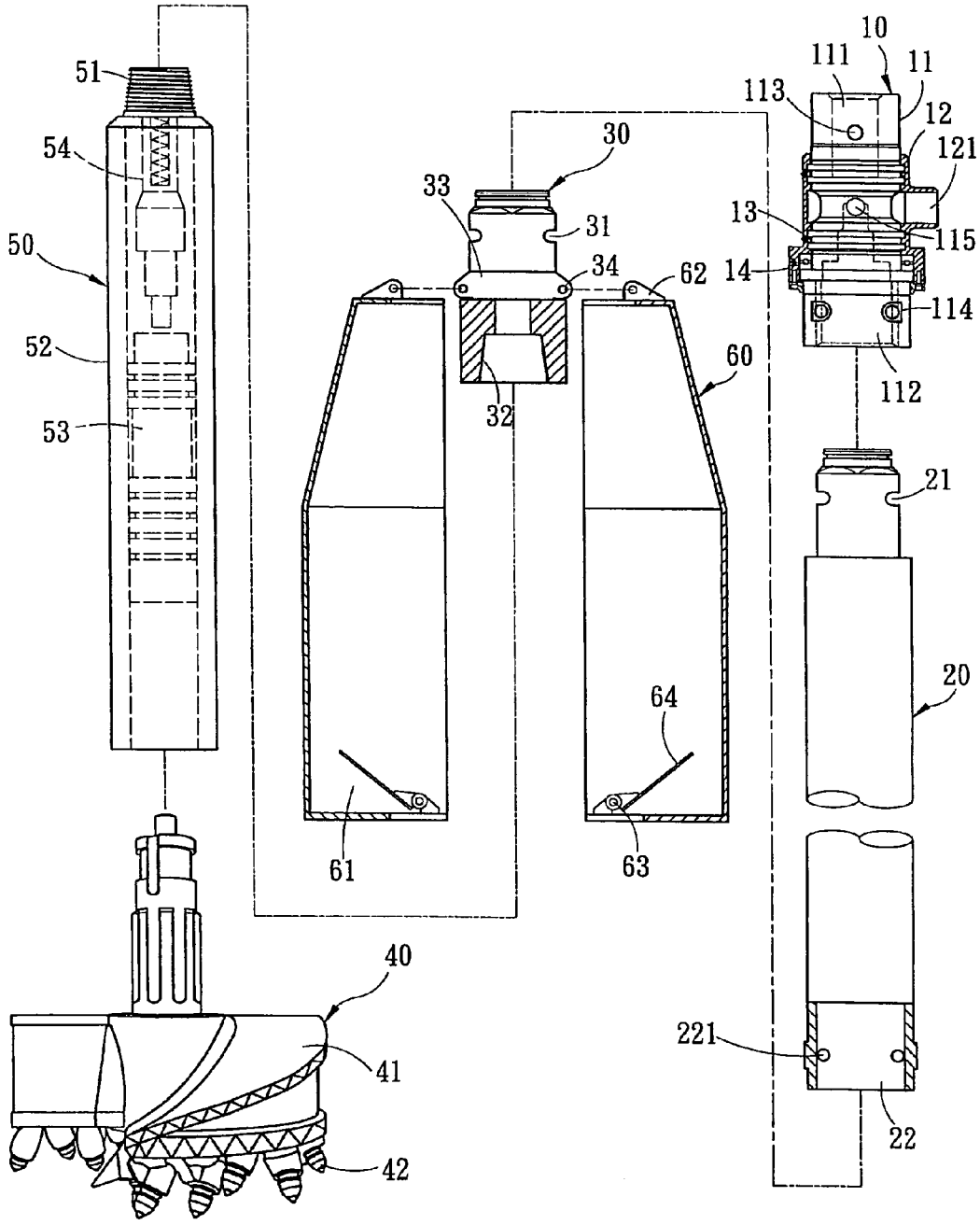
FIG. 1 is an exploded plane view of the present invention.
Figure 2:
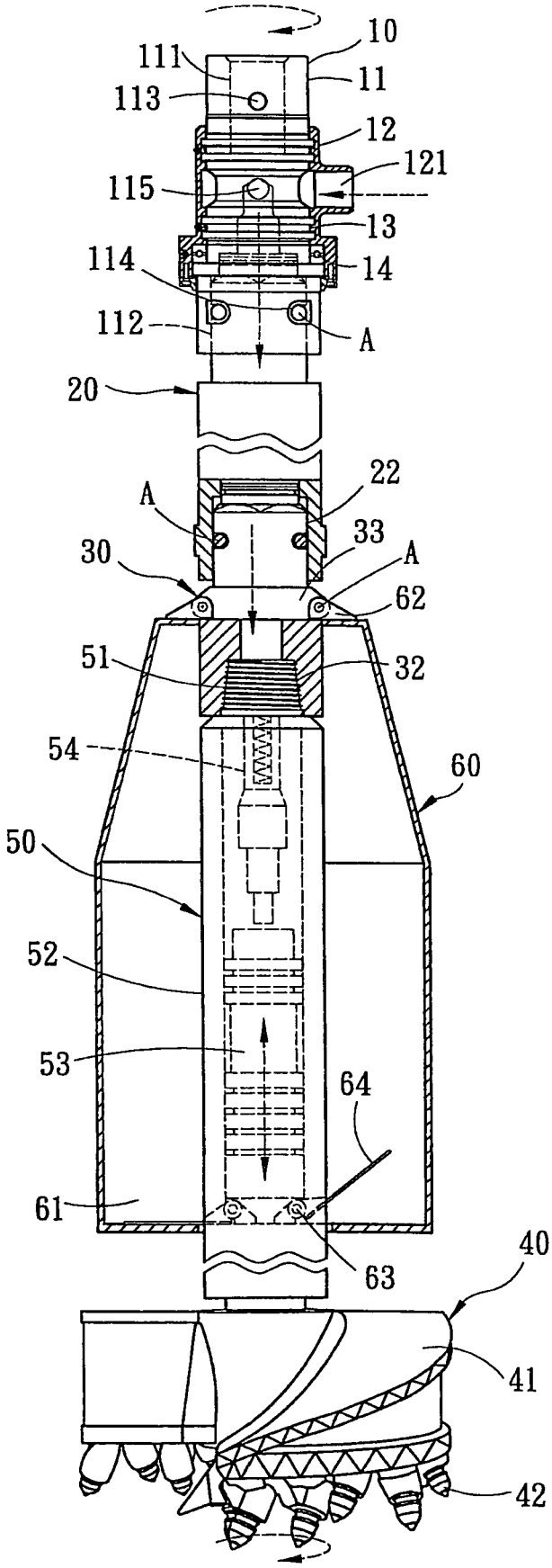
FIG. 2 is a plane view of the present invention in an assembled condition.
Figure 3:
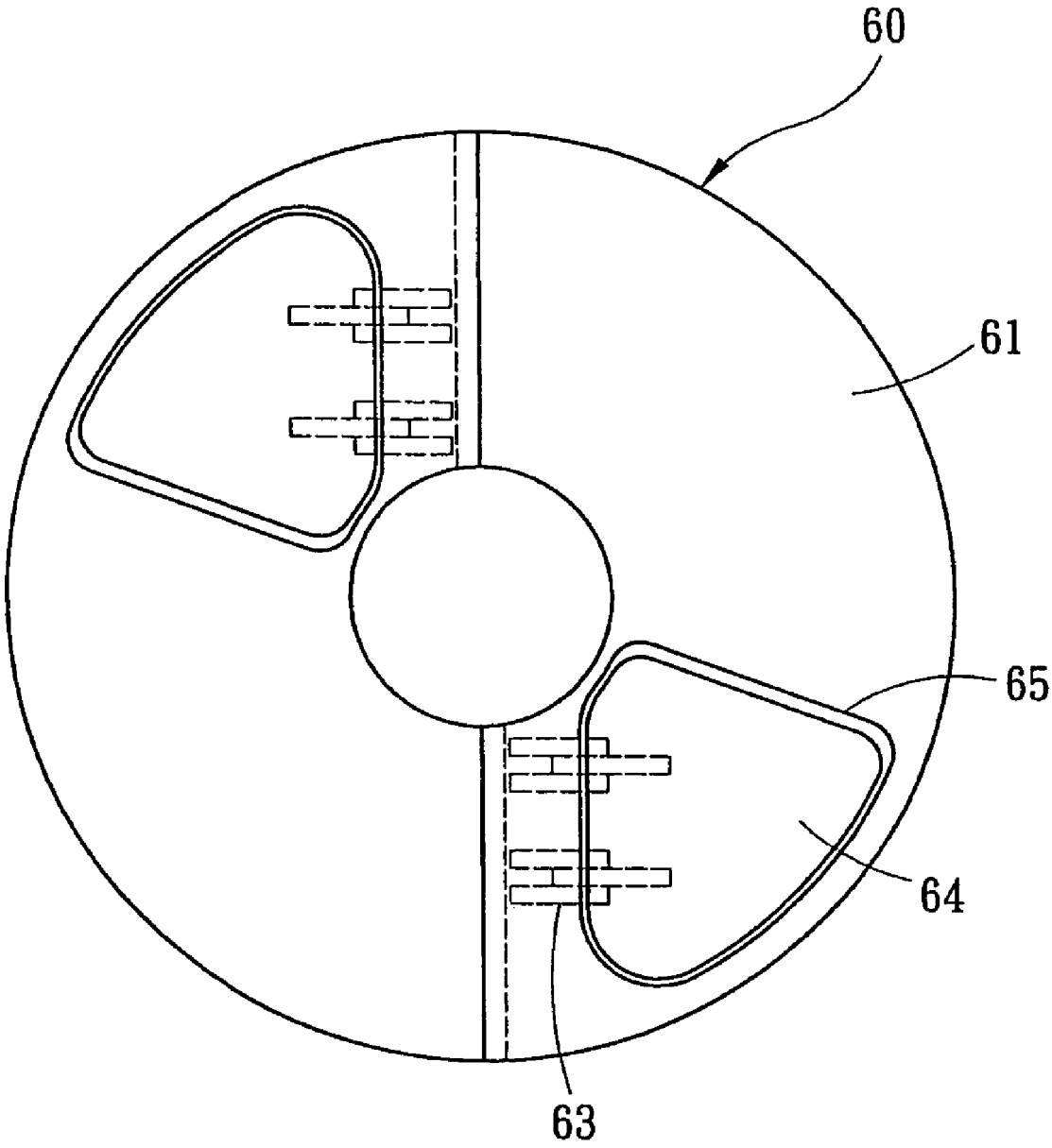
FIG. 3 is a bottom view of the excavator of the present invention.

Please referring to FIGS. 1 and 2, the apparatus according to the invention includes:

a coupling device 10 to connect and transmit a rotational power source and channel air intake of an air pressure source to generate vibration. It includes a coupling axle 11 and an air intake hood 12 coupling on the periphery of the coupling axle 11. The coupling axle 11 has a first housing trough 111 on an upper end to couple with a driving shaft (not shown in the drawings) and a fastening bore 113 to receive a pin A to fasten the driving shaft to the upper end of the coupling axle 11. The coupling axle 11 has a second housing trough 112 on a lower end and fastening bores 114 on two sides. The second housing trough 112 has an aperture 115 in the middle formed in a normal and cross manner. The air intake hood 12 is located around the aperture 115 and has an air inlet 121 on one side connecting to the air pressure source to receive compressed air into the coupling axle 11 through the aperture 115. The air intake hood 12 couples on the outer wall of the coupling axle 11 and is wedged by O-ring 13 to form a sealed space for the air. There is a bearing 14 located between the air intake hood 12 and the coupling axle 11 to prevent the air intake hood 12 from rotating with the coupling axle 11;

a coupling sleeve 20 which has two cavities 21 on the outer wall of one end corresponding to the fastening bores 114 of the second housing trough 112 to receive pins A to fasten the coupling axle 11 and a third housing trough 22 on another end. The third housing trough 22 has two fastening bores 221 on the inner wall. Depending on the drilling depth, the coupling sleeve 20 of different lengths may be replaced and used, or more than one coupling sleeve 20 may be coupled and used;

a connector 30 which has one end shrunk to form a cavity 31 to match the fastening bores 221 of the third housing trough 22 to receive pins A to couple the connector 30 at the lower end of the coupling sleeve 20. The connector 30 has internal screw threads 32 formed on another end. The middle portion of the connector 30 has a pivotal seat 33 with two pivotal holes 34 on two sides;

a drill 40 to couple with a pneumatic unit 50. The pneumatic unit 50 has external screw threads 51 on one end to couple with the internal screw threads 32 of the connector 30. The drill 40 has helical shells 41 at one end that have a plurality of drill gimlets 42 located thereon at different angles in a biased manner. Each of the drill gimlets 42 has a conical end. The drill shells 41 may be altered according to the diameter of the service shaft 70 without changing the diameter of the pneumatic unit 50. The conical and biased drill gimlets 42 exert forces in a biased manner and can effectively strike and shatter the bedrock and increase the drilling speed. The drill 40 has another end coupled with the pneumatic unit 50 which drives the drill 40 to vibrate reciprocally to shatter the bedrock. The pneumatic unit 50 includes a cylinder 52 which houses a reciprocal piston 53. Compressed air may be channeled into the cylinder 52 to push and move the piston 53. A reciprocal mechanism 54 is provided to drive the piston 53 moving reciprocally in the cylinder 52 thereby to drive the drill 40 to vibrate up and down; and an excavator 60 which includes symmetrical conical barrels that have respectively a hollow housing chamber 61 for holding excavated soils. The excavator 60 has a pair of lugs 62 on an upper end to couple with the pivotal holes 34 of the connector 30 to receive pins A to pivotally couple the excavator 60 on the pivotal seat 33 of the connector 30. The excavator 60 has a one-way lid 64 pivotally coupled on a pivot axis 63 on the bottom (referring to FIG. 3). The bottom of the one-way lid 64 rests on a retaining flange 65 so that the one-way lid 64 may be opened only upwards.

By means of the construction set forth above, when in use as shown in FIG. 2, air pressure source delivers compressed air through the air inlet 121 of the air intake hood 12 of the coupling device 10 into the cylinder 52 to push the piston 53 moving reciprocally between the reciprocal mechanism 54 and the drill 40, and the drill 40 is driven to vibrate up and down. The first housing trough 111 of the coupling axle 11 is coupled to the transmission shaft (not shown in the drawings). When the power source drives the transmission shaft rotating, the coupling axle 11, coupling sleeve 20, connector 30, pneumatic unit 50 and the drill 40 also are driven to rotate. Hence the rotational driving power is transmitted to the drilling and excavating apparatus. The gravity of the drilling and excavating apparatus and the up and down reciprocal vibration of the pneumatic unit 50 drive the drill 40 to strike and shatter bedrock continuously. The conical and biased drill gimlets 42 can drill the bedrock in various angles other than vertical so that the shattered rocks and waste soils are scattered sideward without spreading upwards and creating a lot of dusts. As a result, pollution of the construction site may be reduced.

Figure 4A:
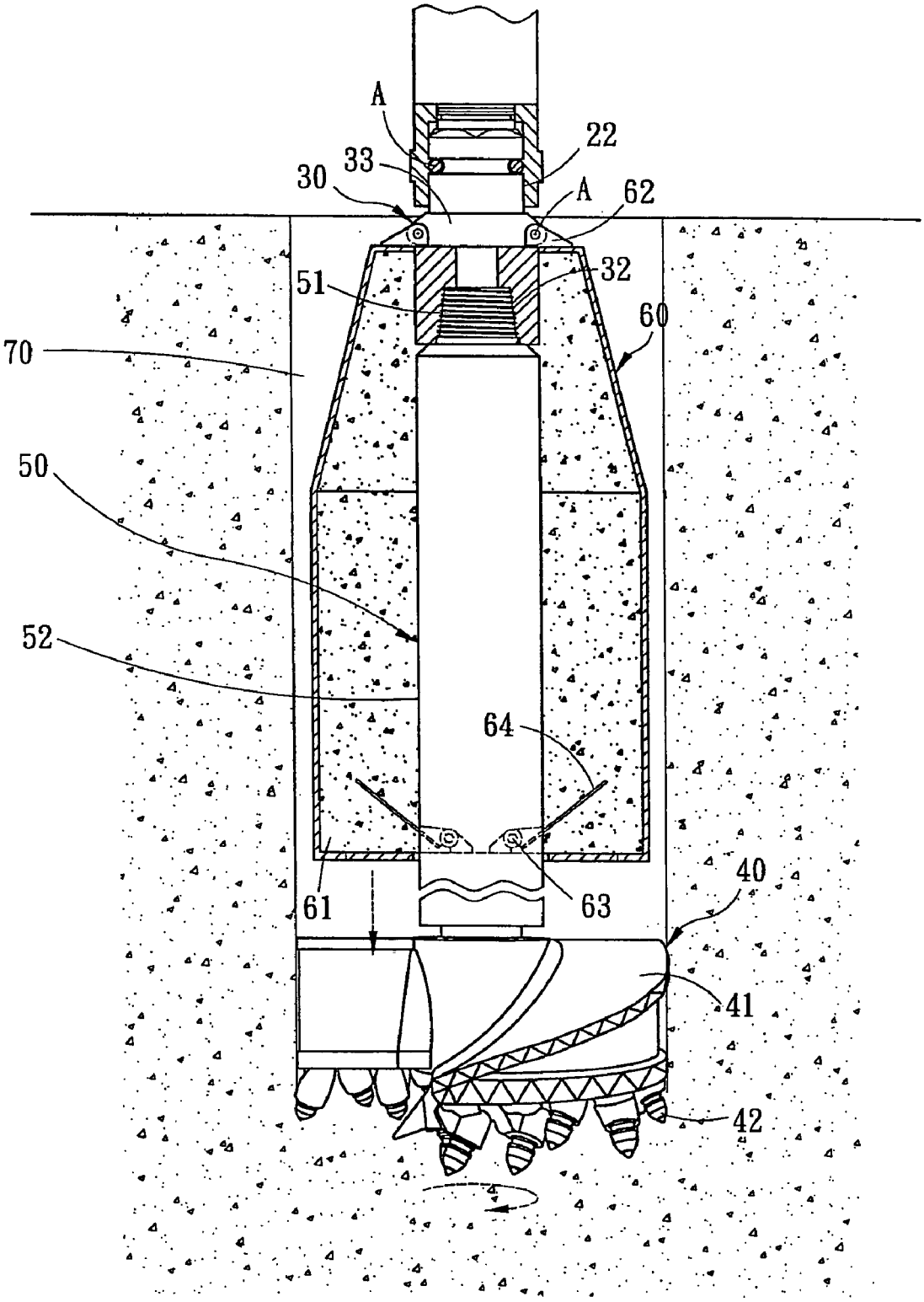
FIG. 4A is a schematic view of shattered rocks and waste soils loading in an excavator during drilling operation.
Figure 4B:
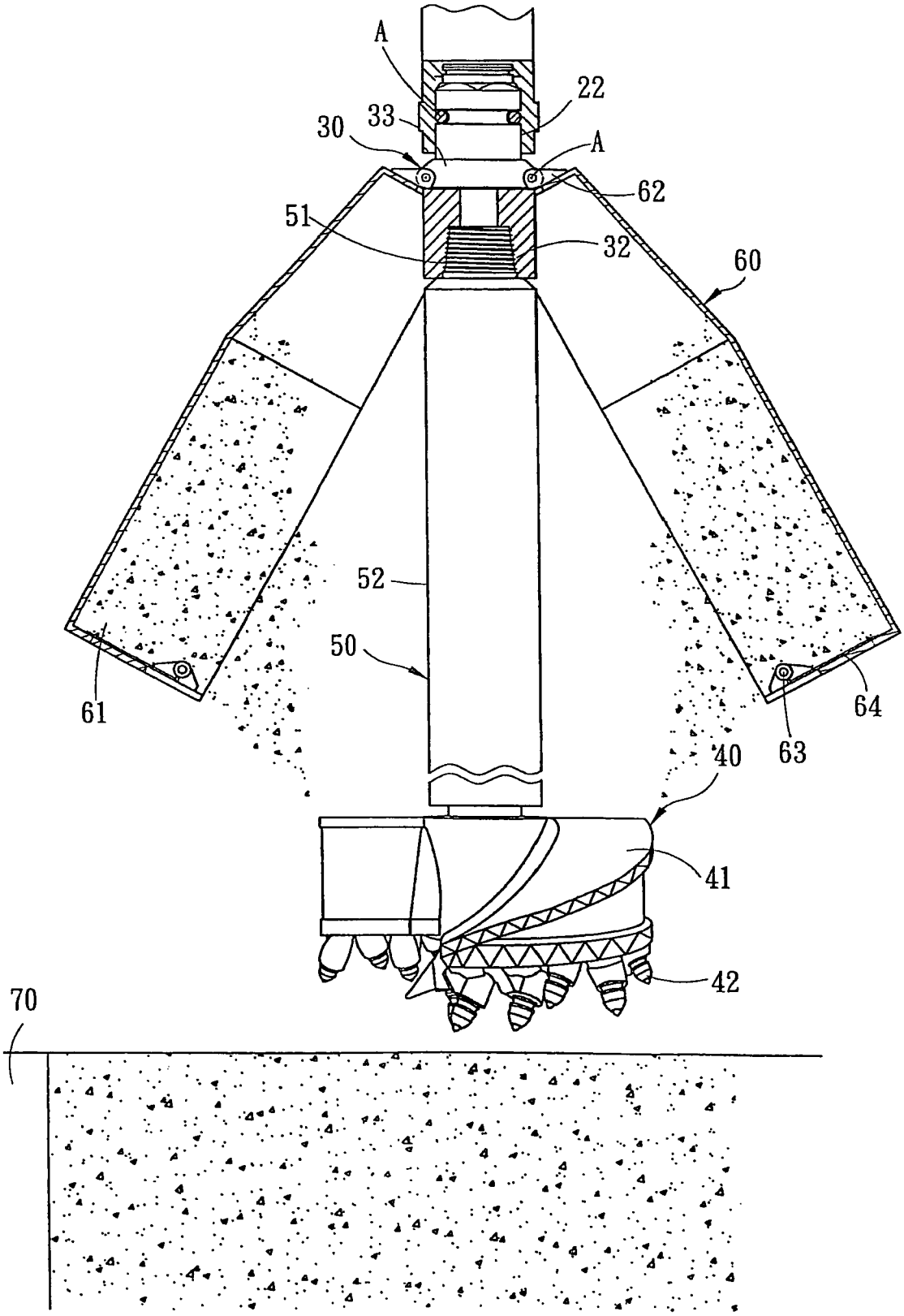
FIG. 4B is a schematic view of dumping the shattered rocks and waste soils from the excavator.
Figure 5A:
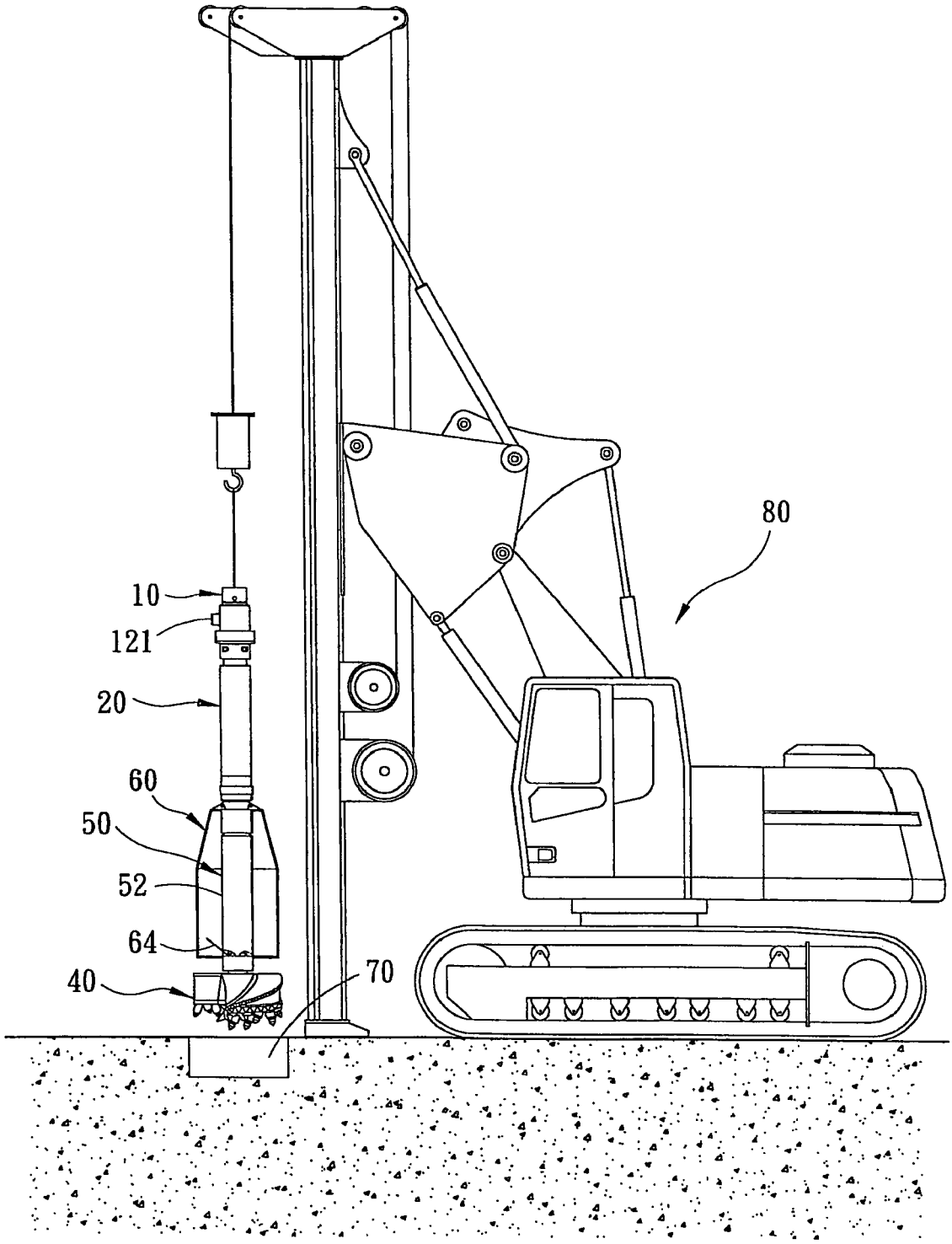
FIGS. 5A through 5D are schematic views of the present invention in operating conditions.
Figure 5B:
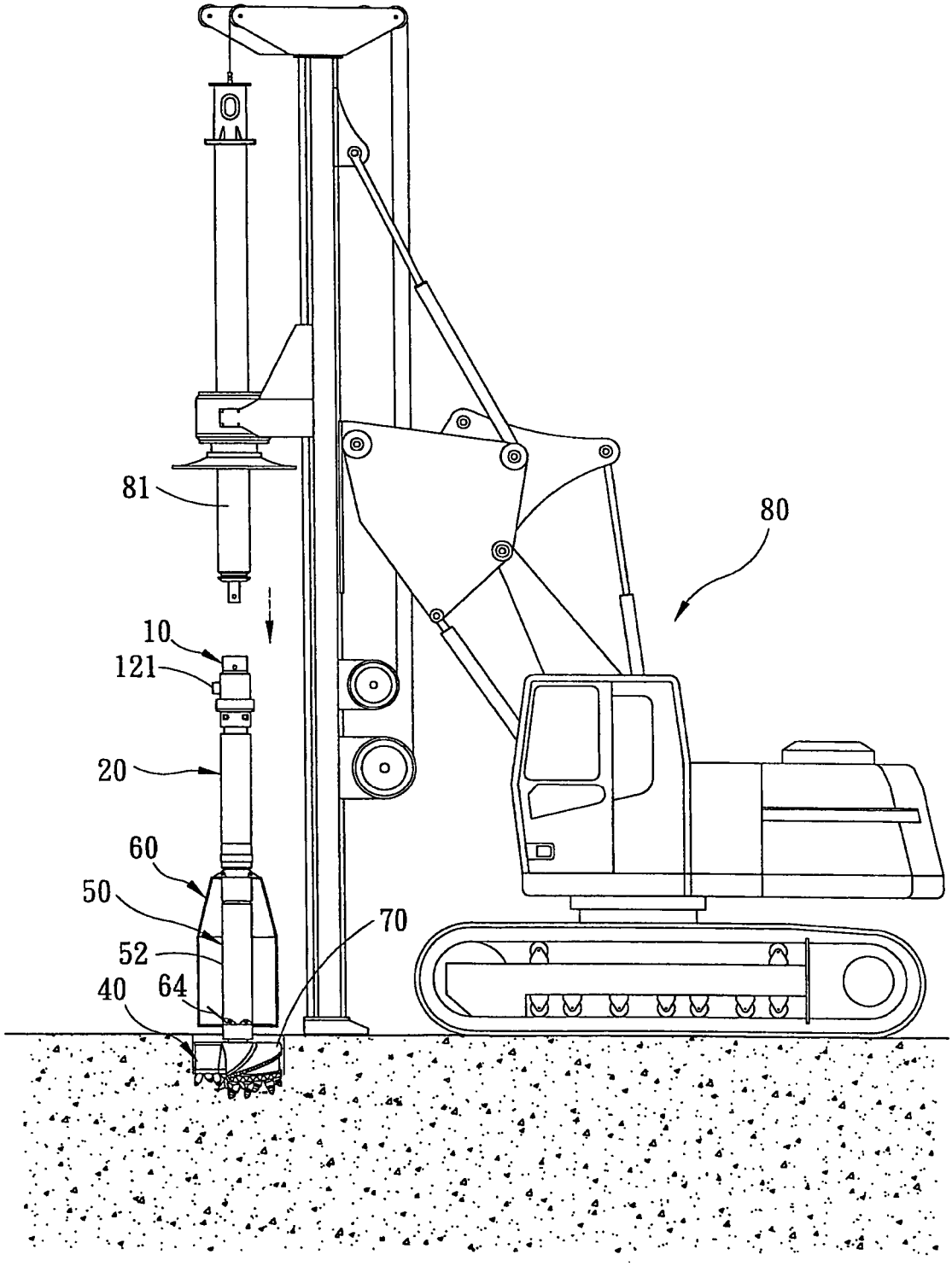
Figure 5C:
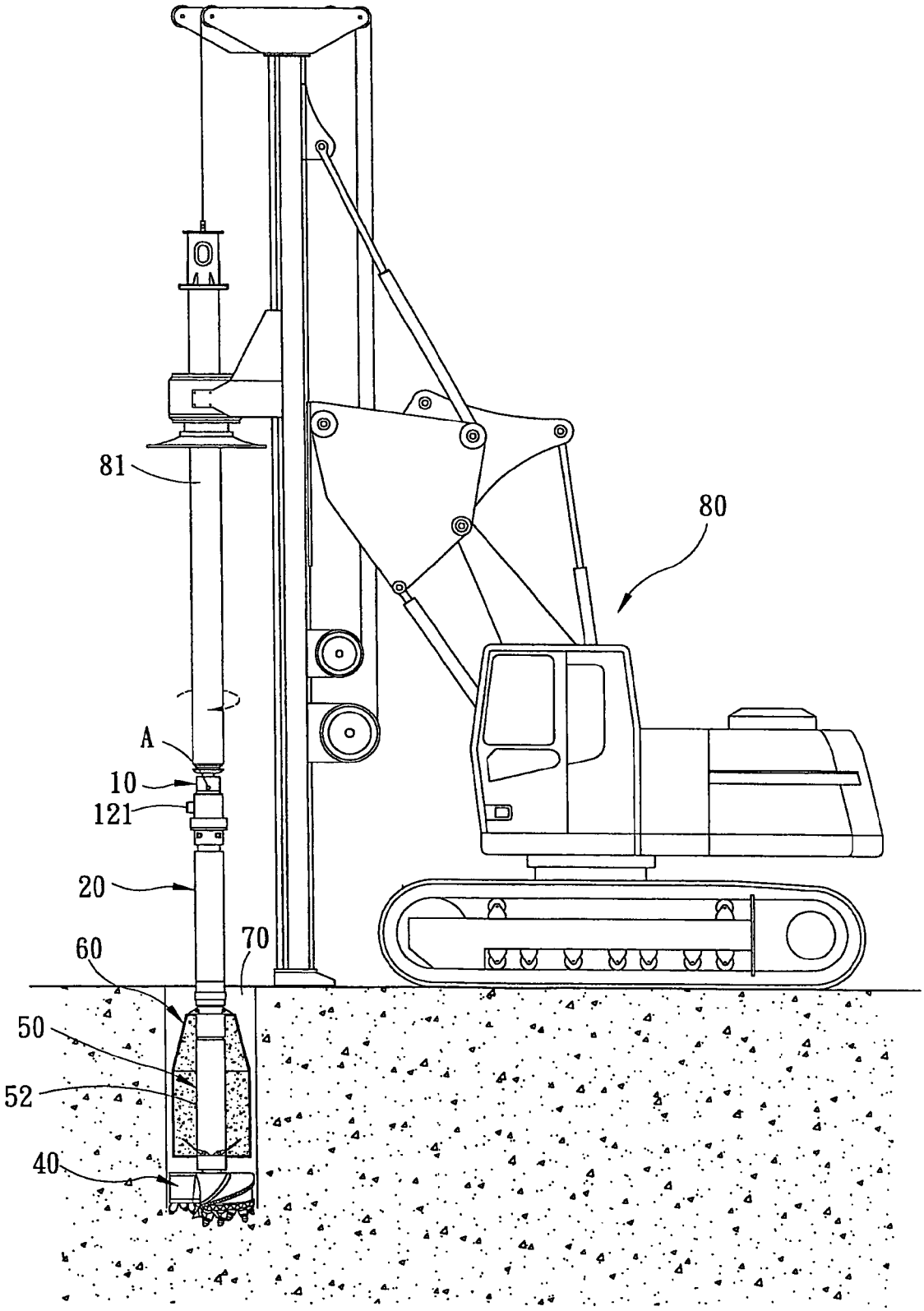
Figure 5D:
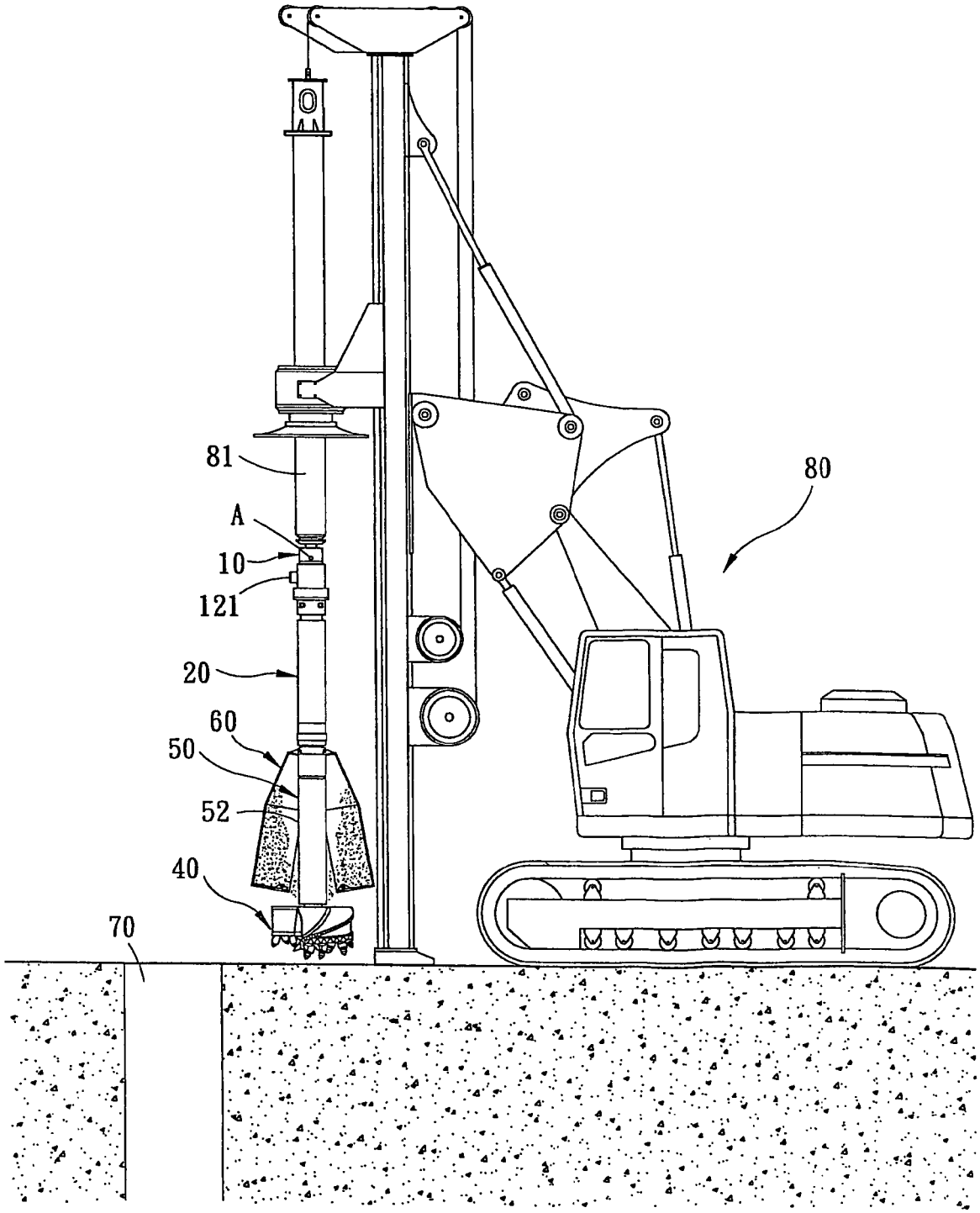

Refer to FIGS. 4A and 4B for the excavator 60 of the invention in operating conditions to excavate the shattered rocks and waste soils during drilling. While the entire apparatus is sunk in the service shaft 70 and the drill 40 continuously drills the bedrock, the shattered rocks and waste soils are channeled upwards into the housing chamber 61 of the excavator 60 through the one-way lid 64. This process continues during the drilling operation. The shattered rocks and waste soils are accumulated in the excavator 60 due to one-way lid 64, the weight of the shattered rocks and waste soils and the retaining flange 65 without dropping until the drill 40 reaches a selected depth and the excavator 60 is fully loaded. Then the rotational power source and compressed air supply may be stopped, and the drill 40 is lifted from the service shaft 70 and moved to one side to dump the shattered rocks and waste soils on the ground. The drill 40 is rotated continuously. The excavator 60 may be swiveled open due to the centrifugal force to completely unload the shattered rocks and waste soils. Thus the invention can excavate the shattered rocks and waste soils during drilling in one process.

Refer to FIGS. 5A through 5D for the main operation procedures of the invention. They include the steps of:

I. Couple the coupling device 10 with an air pressure source, and hoist the entire apparatus by a heavy machinery 80 into the service shaft 70;

II. Couple a transmission shaft 81 of the heavy machinery 80 with the first housing trough 111 of the coupling device 10 to output the driving power, and fasten the two through a pin A;

III. Start drilling operation (the transmission shaft 81 drive the drill 40 to rotate and drill downwards, meanwhile, the pneumatic unit 50 receives compressed air to push the drill 40 to generate up and down vibrations);

IV. Channel shattered rocks and waste soils into the excavator 60 during drilling operation;

V. Stop drilling and excavating operations. Remove the entire apparatus from the service shaft 70 to one side and continuously rotate the drill 40 and excavator 60 so that the excavator 60 is swiveled open to unload the shattered rocks and waste soils.

By adopting the procedures set forth above, drilling and excavation of the shattered rocks and waste soils in the service shaft 70 may be accomplished in one process. In addition, the pneumatic unit 50 enables the drill 40 to drill and shatter the bedrock simultaneously.

Figure 6:
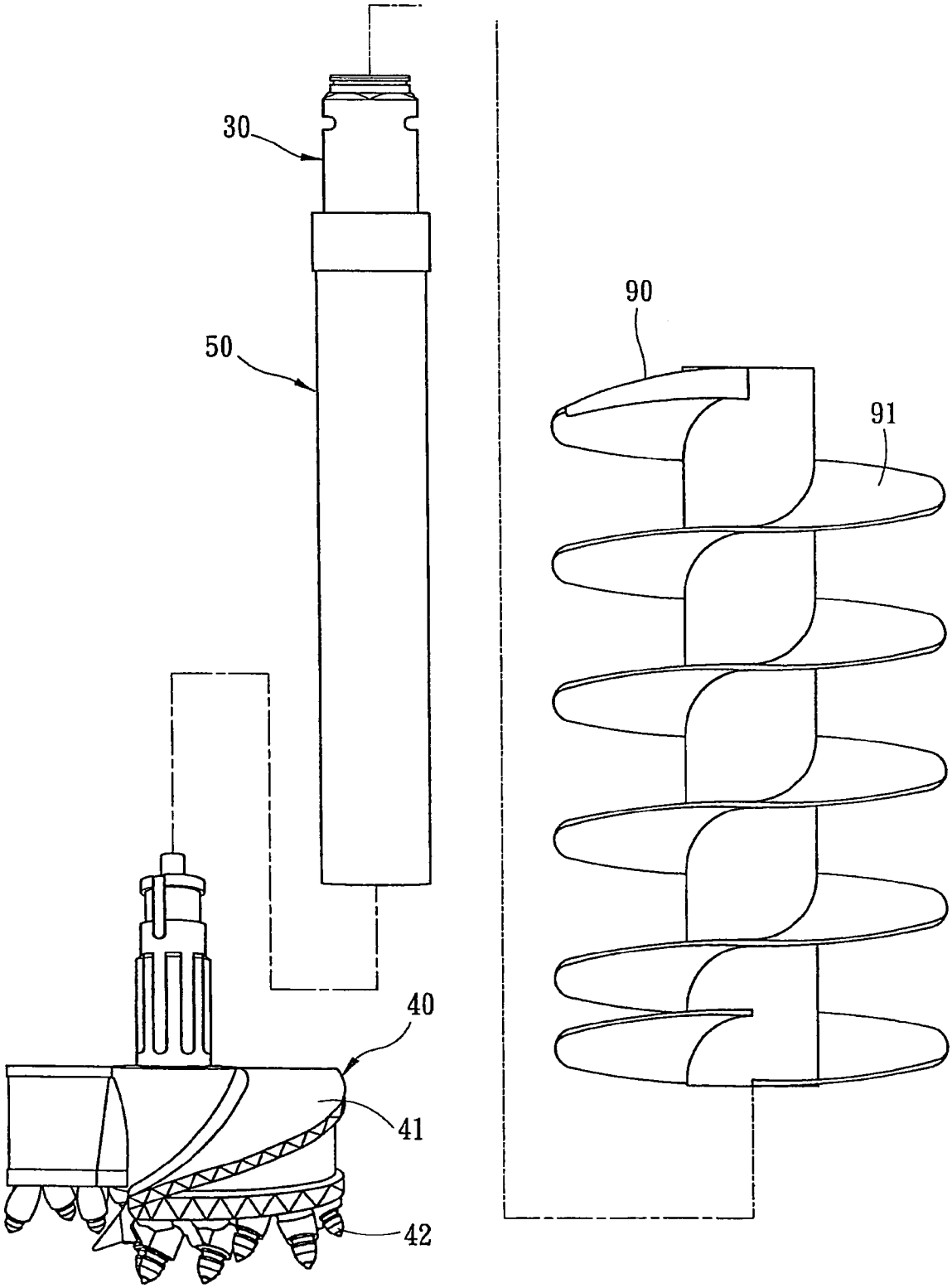
FIG. 6 is an exploded plane view of another embodiment of an excavator to be mounted on the periphery of the pneumatic unit.
Figure 7:
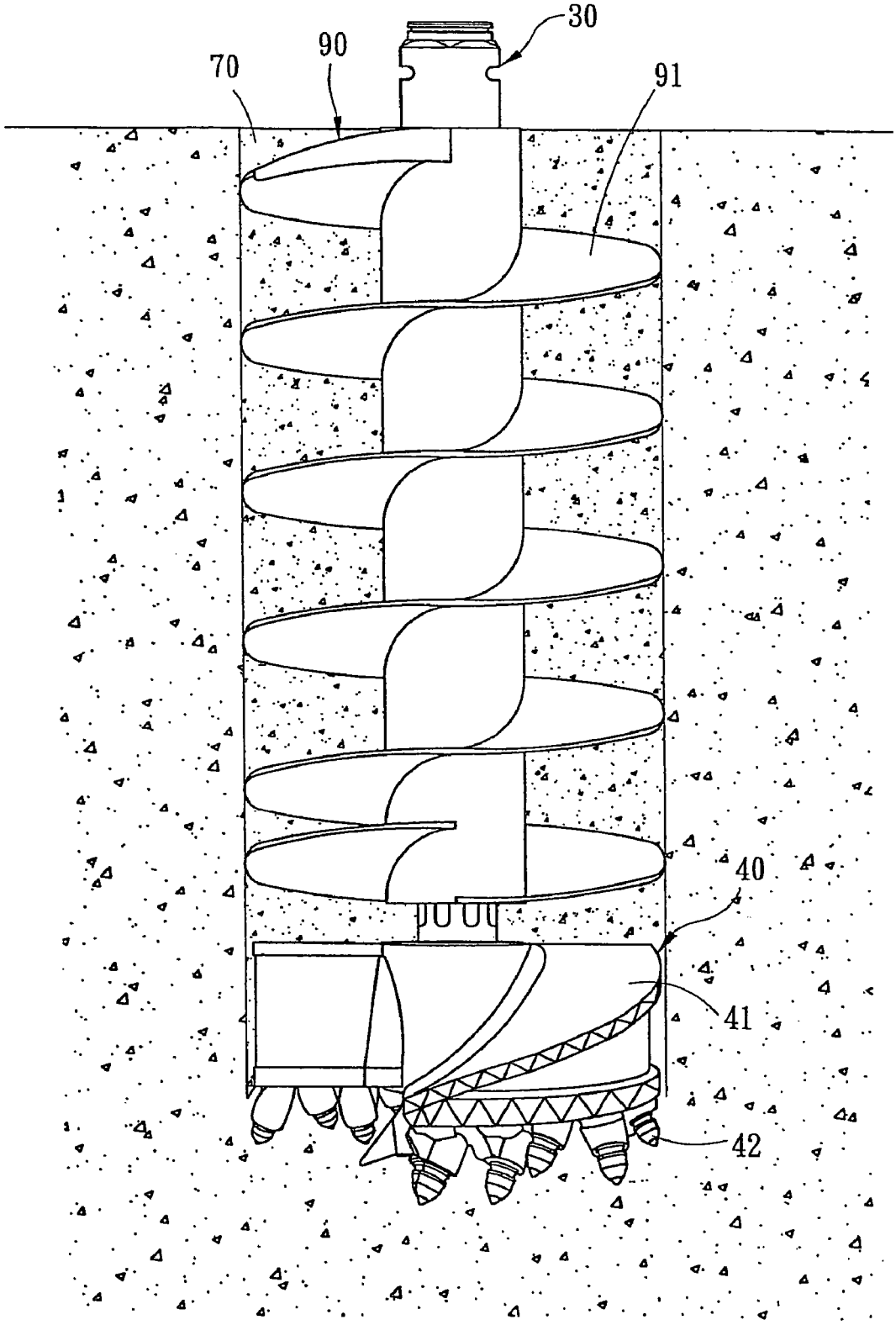
FIG. 7 is a plane view of another embodiment of an excavator mounted on the periphery of the pneumatic unit.

Refer to FIGS. 6 and 7 for another embodiment of an excavator 90 of the invention. The stratum, besides having the soft type and hard type depending on the areas, the soil may also be dry or damp. The excavator 60 previously discussed is suitable for the service shaft 70 that has water injected therein during drilling and excavating operations. The soil is damp and has a greater adsorption force so that the excavator 60 can directly scoop the shattered rocks and waste soils. In the occasion where water injection is not available during drilling and excavating operations, and the soil is dry, the excavator 90 is more suitable in such an environment.

The excavator 90 is a tubular structure with a continuous helical wing 91 wound on the periphery thereof. The entire excavator 90 is coupled on the pneumatic unit 50 from outside (between the connector 30 and the drill 40) and fastened together. While the drill 40 is turned and drills downwards, the excavator 90 rotates synchronously. The helical wing 91 rotates to scoop the dry shattered rocks and waste soils. When the drilling operation stops at a selected depth, and the drill 40 is moved upwards, the shattered rocks and waste soils are moved out with the helical wing 91. Thus drilling and excavating of shattered rocks and waste soils in the service shaft 70 may be accomplished in one process.

While the preferred embodiments of the invention have been set forth for the purpose of disclosure, modifications of the disclosed embodiments of the invention as well as other embodiments thereof may occur to those skilled in the art. Accordingly, the appended claims are tended to cover all embodiments which do not depart from the spirit and scope of the invention.

What is claimed is:

1. A bedrock drilling and excavating apparatus, comprising:

a coupling device to couple with a rotational power source and an air pressure source for generating vibration;

a connector coupling with a lower end of the coupling device and a pneumatic unit;

an excavator coupled on an outer side of the pneumatic unit, the excavator having a continuous and helical wing on the periphery thereof; and a drill coupling with the pneumatic unit;

wherein the drill includes a drill shell which has a plurality of drill gimlets mounted thereon, the drill shell being alterable according to the drilling diameter without changing the diameter of the pneumatic unit, each of the drill gimlets having a conical end and being mounted onto on the drill shell in a different angle, the coupling device transmitting rotational power from the rotational power source and channeling the air pressure source to the pneumatic unit to allow the drill to generate rotation and longitudinal and reciprocal vibrations to perform downward drilling and excavation;

wherein the pneumatic unit includes a cylinder which houses a reciprocal piston, the cylinder receiving compressed air to drive the piston which is moved reciprocally through a returning mechanism to move the drill for generating up and down vibrations.

2. The bedrock drilling and excavating apparatus of claim 1, wherein the connector has a pivot seat on an outer wall to pivotally couple with the excavators.

3. A bedrock drilling and excavating apparatus comprising:

a coupling device to couple with a rotational power source and an air pressure source for generating vibration;

a connector coupling with a lower end of the coupling device and a pneumatic unit; and a drill coupling with the pneumatic unit;

wherein the drill includes a drill shell which has a plurality of drill gimlets mounted thereon, the drill shell being alterable according to the drilling diameter without changing the diameter of the pneumatic unit, each of the drill gimlets having a conical end and being mounted onto on the drill shell in a different angle, the coupling device transmitting rotational power from the rotational power source and channeling the air pressure source to the pneumatic unit to allow the drill to generate rotation and longitudinal and reciprocal vibrations to perform downward drilling and excavation;

wherein the coupling device provides rotational power transmission and air intake vibration and includes a coupling axle and an air intake hood encasing the periphery of the coupling axle, the coupling axle having a first housing trough on an upper end to couple with a driving shaft and a fastening bore to receive a pin for fastening and an aperture, the air intake hood communicating with the coupling axle to receive input from the air pressure source and covering the aperture.

4. The bedrock drilling and excavating apparatus of claim 3, wherein the coupling device and the connector are bridged by a coupling sleeve.

5. The bedrock drilling and excavating apparatus of claim 4, wherein the coupling sleeve of a different length is replaceable when in use or more than one of the coupling sleeve is coupled according to drilling depth.

6. The bedrock drilling and excavating apparatus of claim 4, wherein the coupling axle and the coupling sleeve are coupled and fastened through pins.

7. The bedrock drilling and excavating apparatus of claim 4, wherein the connector and the coupling sleeve are coupled and fastened through pins.

8. A bedrock drilling and excavating apparatus comprising:

a coupling device to couple with a rotational power source and an air pressure source for generating vibration;

a connector coupling with a lower end of the coupling device and a pneumatic unit; and excavators which are pivotally coupled on an outer wall of the connector in a symmetrical and extendable manner, each of the excavators having an one-way lid pivotally coupled on the bottom thereof, the one-way lid having a bottom stopping by a retaining flange such that the one way lid is openable only inwards;

a drill coupling with the pneumatic unit;

wherein the drill includes a drill shell which has a plurality of drill gimlets mounted thereon, the drill shell being alterable according to the drilling diameter without changing the diameter of the pneumatic unit, each of the drill gimlets having a conical end and being mounted onto on the drill shell in a different angle, the coupling device transmitting rotational power from the rotational power source and channeling the air pressure source to the pneumatic unit to allow the drill to generate rotation and longitudinal and reciprocal vibrations to perform downward drilling and excavation.

* * * * *